US005598936A

United States Patent [19]

Murphy

[11] Patent Number: 5,598,936

[45] Date of Patent: Feb. 4, 1997

[54] COUPLER CARRIER WEAR PLATE FOR LONG-SHANK COUPLERS

[75] Inventor: Richard F. Murphy, Batavia, Ill.

[73] Assignee: Zeftek, Inc., Montgomery, Ill.

[21] Appl. No.: 511,457

[22] Filed: Aug. 4, 1995

[51] Int. Cl.[6] ..... B61G 7/10

[52] U.S. Cl. ..... 213/61; 213/75 R

[58] Field of Search ..... 213/60, 61, 62 R, 213/75 R, 104

[56] References Cited

U.S. PATENT DOCUMENTS

| | | | |
|---|---|---|---|
| 2,515,964 | 7/1950 | Metzger | 213/60 |
| 3,104,017 | 9/1963 | Kulieke et al. | 213/60 |
| 3,417,876 | 12/1968 | Stretch et al. | 213/61 X |
| 3,600,047 | 8/1971 | MacDonnell | 308/138 |
| 4,706,826 | 11/1987 | Elliott et al. | 213/61 |
| 4,762,941 | 8/1988 | Chen et al. | 558/44 |
| 4,846,358 | 7/1989 | Rhen | 213/64 |
| 5,261,599 | 11/1993 | Brown | 238/283 |

*Primary Examiner*—S. Joseph Morano
*Attorney, Agent, or Firm*—Lloyd L Zickert

[57] ABSTRACT

A coupler carrier wear plate for a long-shank coupler which includes a mild steel base plate weldable to the carrier, a manganese steel wear plate engageably supporting the coupler shank and connected to the base plate by a resilient bonding material. The bonding material is of a thickness to accommodate flatness variations encountered on a coupler carrier.

14 Claims, 2 Drawing Sheets

COUPLER CARRIER WEAR PLATE FOR LONG-SHANK COUPLERS

DESCRIPTION

This invention relates in general to a wear plate for a coupler carrier on which a coupler shank is supported, and more particularly to a coupler carrier wear plate having the base plate weldable to the coupler carrier and a bearing plate slidably supporting the coupler shank and being connected to the base plate by a resilient bonding material.

BACKGROUND OF THE INVENTION

Heretofore, it has been known to provide coupler carrier wear plates of hardened steel welded to long-shank couplers. These wear plates were frequently lost due to poor welding techniques or for other various reasons, thereby allowing the bare shanks to contact the high-carbon coupler carriers that in turn suffered heavy wear on the cast steel coupler shanks. These long-shank couplers are found on extra long railroad cars and require a bellmouth of a width more than twice the standard bellmouth in order to permit negotiation of standard and non-standard curves. It is these coupler arrangements where wear plates have not been used successfully. Manganese carriers and other non-metallic carriers have been provided for wide bellmouth applications. Manganese carriers are not weldable to the coupler carrier because welding of manganese to cast iron is extremely difficult.

Secondly, flatness requirements of such a wear plate are needed for longevity and such requirements exceed the manufacturing tolerances for manganese.

Non-metallic wear plates usually cannot withstand the extremely heavy loading pressures demanded by long-shank couplers, thereby resulting in early failure. Recently, the requirement for equipping long shanks of couplers with shank wear plates has been discontinued. Accordingly, the problem of wear experienced with the coupler shank and the carrier tends to reduce the effective lifetime of the shank and/or carrier, thereby requiring early maintenance.

SUMMARY OF THE INVENTION

The coupler carrier of the present invention overcomes the above referred to problems in providing a coupler wear plate that is easily weldable to the coupler carrier and which includes a bearing plate that is softer than the shank in order to minimize shank wear and which overcomes the extremely tight flatness requirement. Accordingly, the tight flatness requirement now required can be ignored by utilizing the present invention.

The carrier wear plate of the present invention includes a mild steel base plate easily weldable to the coupler carrier and a manganese steel bearing plate bonded to the base plate by a resilient bonding material such as a urethane or other rubber type material. The relationship between the wear plate and the bearing plate, because of the bonding material, neutralizes irregularities in order to meet all lateral tolerance variations commonly found on a flatcar coupler carrier. Further, the structure of the wear plate of the present invention neutralizes the need of the shank to be in the same parallel plane as the coupler carrier, thereby accommodating regularly occurring shank twist. The resiliency of the rubber type bonding material gives or yields to neutralize the flatness requirement of the manganese wear plate.

It is therefore an object of the present invention to provide a new and improved carrier wear plate for coupler shanks.

It is a further object of the present invention to provide a new and improved coupler wear plate for a long-shank coupler used in wide bellmouth carriers.

It is a further object of the present invention to provide a coupler wear plate including a base plate weldable to the coupler carrier and a softer bearing plate bonded to the base plate by a resilient bonding material.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
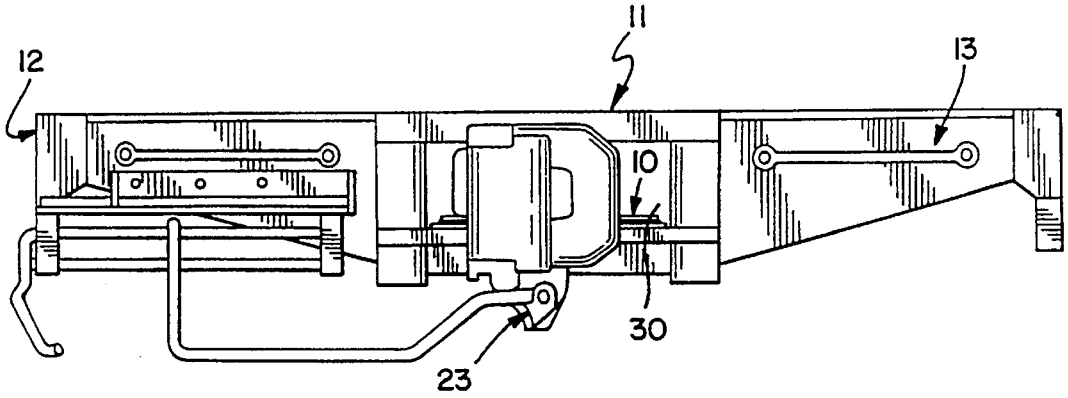
FIG. 1 is a front elevational view of a railroad car having a wide bellmouth carrier for a long-shank coupler and where the trucks have been omitted for simplicity sake.

Referring now to the drawings, and particularly to FIG. 1, a coupler of a railroad car is illustrated wherein the coupler carrier wear plate of the present invention, generally designated by the numeral 10, is shown in mounted position on a coupler carrier 11 of the railroad car 12. For purposes of simplicity, the railroad car is not illustrated with any trucks that would support the car on tracks. The coupler carrier is shown mounted at one end of the railroad car, it being appreciated that a similar coupler carrier would be mounted at the other end of the railroad car, and the carrier is supported by the railroad car frame 13.

The coupler carrier 11 is of the wide bellmouth type used on extra length railroad cars in order to allow a long-shank coupler to swing a sufficient distance when the car is going through a curve. A coupler shank 16 is shown within the coupler carrier and suitably pivotally connected at its inner end to the frame of the car. Moreover, the coupler shank 16 is pivotally connected at its inner end to a vertically extending yoke-connecting pin 17 mounted on a draft mechanism 18 carried within the frame 12. The draft mechanism operates in the standard fashion in that it allows the coupler shank to be withdrawn into the frame support, generally in a cushioned fashion, while limiting the extension of the coupler shank to a predetermined position. At the outer end of the shank 16, a coupler head 20 having a knuckle 21 is provided for suitable coupling to a coupler of an adjacent railroad car the knuckle is pivotally connected to a knuckle pin 22 and suitably lockable in closed position by a locking mechanism not shown. Similarly, the locking mechanism which includes the unlatching member 23 may be actuated as needed in order to release the knuckle during a coupling operation. Thus, the draft mechanism 18 includes a coupler yoke 26 receiving the yoke-connecting pin which extends through a slot 27 at the inner end of the coupler shank 16.

Figure 2:
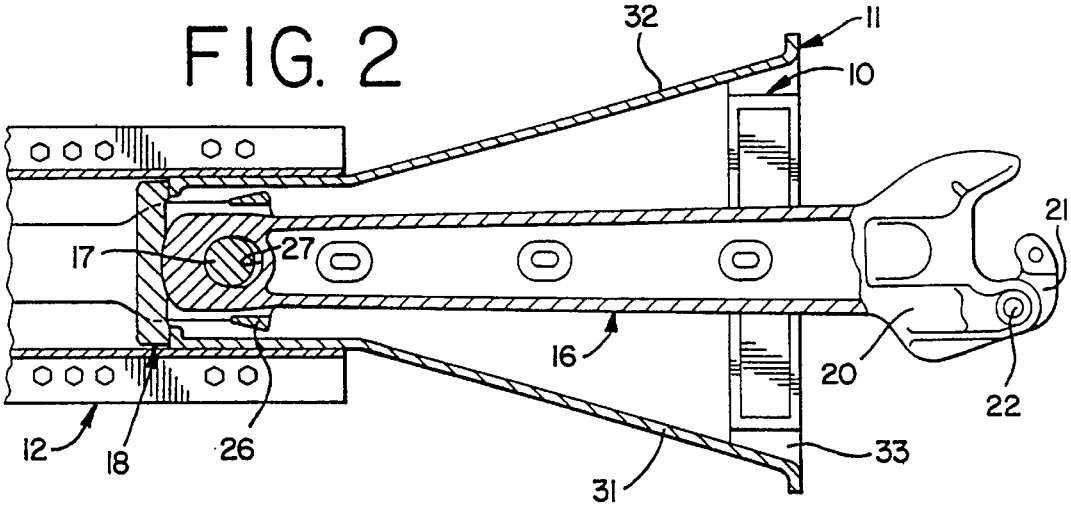
FIG. 2 is a partially fragmentary longitudinal sectional view taken through the coupler shank and the coupler carrier of the railroad car of FIG. 1 to illustrate the wear plate of the invention in relation to the disposition between the coupler carrier and the coupler shank.
Figure 3:
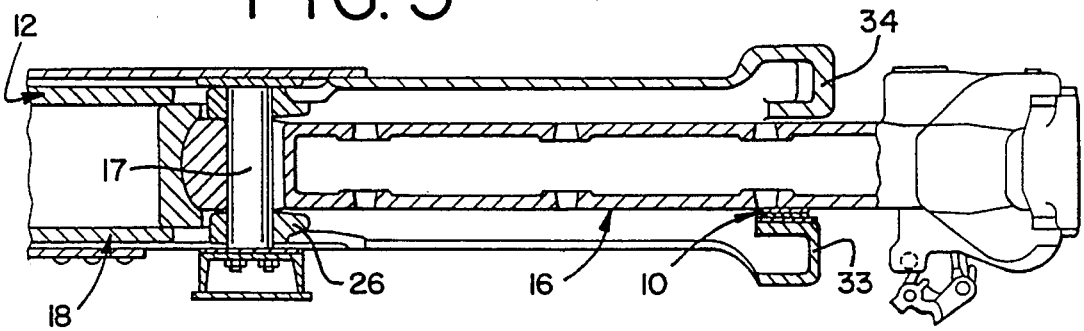
FIG. 3 is a partially fragmentary vertical sectional view of the coupler shank and coupler carrier of FIGS. 1 and 2 and illustrating the position of the coupler carrier wear plate.

The coupler carrier 11 includes a wide opening 30 at its outer end defined by opposed diverging walls 31 and 32, an end sill 33 on which the coupler carrier wear plate is mounted, and an upper cross member 34. As illustrated in FIGS. 1 to 3 as well as FIGS. 5 and 6, the coupler shank 16 rests on the coupler carrier wear plate and is slidably supported such that it can swing about the connecting yoke pin 17 laterally on the wear plate within the confines of the opening 30. The maximum swinging movement is limited by the opposed walls 31 and 32.

Figure 4:
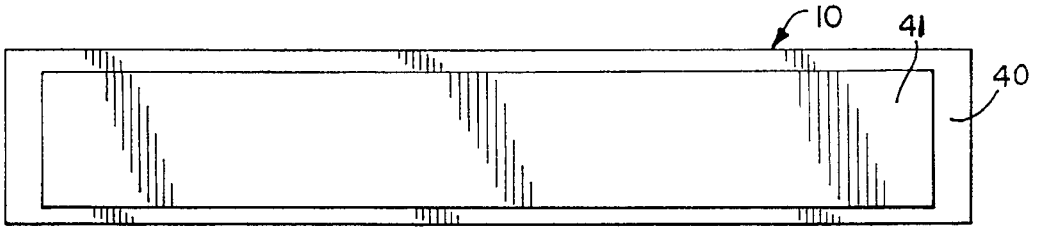
FIG. 4 is a top plan view of the coupler carrier wear plate of the present invention.
Figure 5:
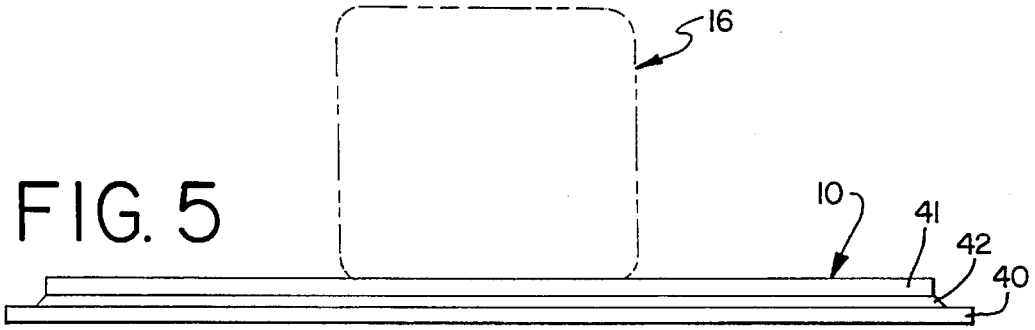
FIG. 5 is a front elevational view of the coupler carrier wear plate of FIG. 4, and showing the position of the coupler shank in phantom.
Figure 6:
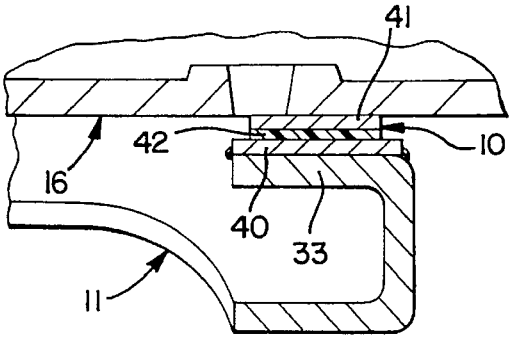
FIG. 6 is an enlarged vertical sectional view taken through the coupler carrier and the coupler wear plate of the present invention as well as the coupler shank to illustrate the manner in which the coupler wear plate is welded to the coupler carrier and serving to bearingly support the coupler shank.

The coupler carrier wear plate of the present invention, as more particularly illustrated in FIGS. 4 to 6, includes a mild steel base plate 40, a manganese steel bearing plate 41, and an intermediate interconnecting resilient bonding layer 42.

The mild steel base plate 41 is mounted onto the end sill 33 and welded in place, thereby connecting the wear plate 10 to the carrier. Because the base plate is of a mild steel, it is easily weldable to the end sill of substantially similar material.

The manganese steel bearing plate supports the hardened steel coupler shank and serves as a suitable bearing surface to minimize wear on the shank.

The resilient bonding material which bonds the manganese steel bearing plate to the mild steel base plate is of a suitable natural or synthetic rubber-type bonding material. Any suitable elastomeric or rubber-type bonding material may be employed to connect the plates together. For example, it may be of a polyurethane bonding material or of a urethane bonding material that will suitably bond to both the mild steel base plate and the manganese steel bearing plate.

The mild steel base plate 40 is approximately one-quarter inch thick. Similarly, the manganese steel bearing plate 41 is approximately one-quarter inch thick. The rubber-type bonding material layer 42 is preferably about 0.0625 inch thick. As seen particularly in FIG. 4, the manganese steel bearing plate is slightly smaller dimensionally than the mild steel base plate. Preferably, there should be at least about a one-half inch border around the manganese steel base plate; that is, the mild steel base plate would be approximately one-half inch peripherally larger than the bearing plate so as to facilitate the welding of the base plate to the coupler carrier.

The bonding material is also preferably about 90 durometer in hardness on the Shore A scale. Both the thickness of the resilient layer and the hardness of the material accommodate the flatness variations of the bearing plate and the base plate. The relative softness of the bonding layer is important to allow for the carrier's surface irregularities, thereby making the wear plate of the invention efficient for slidably supporting the coupler shank.

Figure 7:
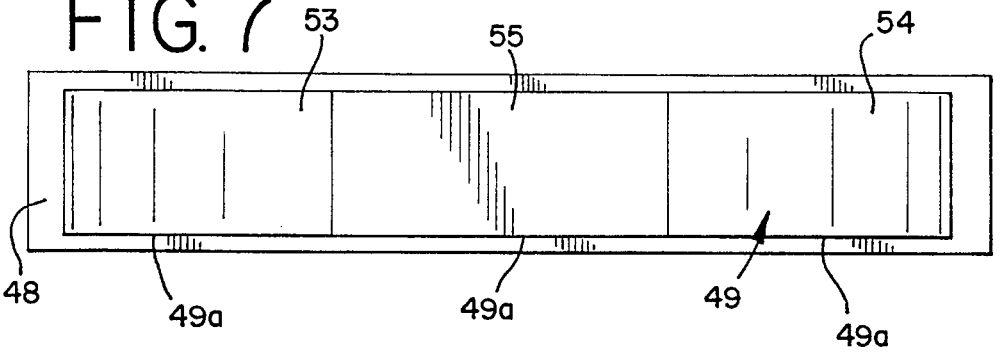
FIG. 7 is a top plan view of a modified coupler carrier wear plate according to the invention.
Figure 8:
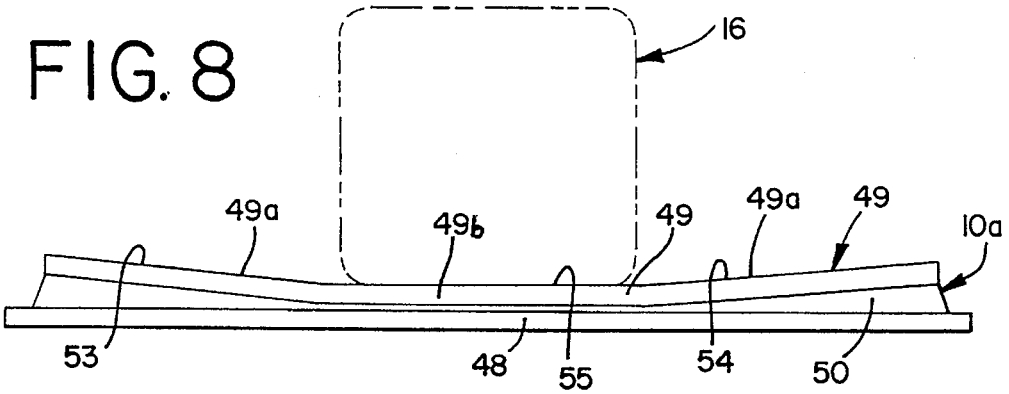
FIG. 8 is a front elevational view of the coupler carrier wear plate of FIG. 7.

The embodiment of FIGS. 7 and 8 differs from the embodiment of FIGS. 4 and 5 in that the coupler carrier wear plate is formed to assist in centering the coupler shank 16 when the coupler is unconnected. This wear plate is generally designated by the numeral 10A and includes a mild steel base plate 48, a manganese steel bearing plate 49, and a layer of resilient bonding material 50. This embodiment differs from the embodiment of FIGS. 4 and 5 in that it is structured to assist in the centering of the coupler shank during use. In order to accomplish this centering operation, the opposite end portions of the bearing plate are upwardly inclined as shown by the end portions 49*a*. These end portions 49*a* are inclined upwardly from the central area 49*b* about five degrees so as to provide downwardly and inwardly sloping surfaces 53 and 54 leading to the central horizontal portion 49*b*. Thus, with no force being applied to the coupler, that is, when the coupler is not connected to another coupler, the shank would normally tend to move toward the center by gravity in order to provide the coupler head at a location for coupling with an adjacent coupler. Thus, the surfaces 53 and 54 lead to the horizontal surface 55 of the central portion 49*b*. Otherwise, this embodiment also serves to accommodate flatness variations of the components of the coupler system. In operation, where the coupler shank would be positioned on one of the inclined surfaces of the bearing member, gravitational forces on the shank would normally cause the coupler shank to slide downwardly to the center horizontal area 49*b*.

It will be understood that modifications and variations may be effected without departing from the scope of the novel concepts of the present invention, but it is understood that this application is to be limited only by the scope of the appended claims.

The invention is hereby claimed as follows:

1. A coupler carrier wear plate for long-shank couplers which comprises:

a steel base plate adapted to be welded to the coupler carrier, a steel bearing plate adapted to slidably support and engage the coupler shank, and rubber-type resilient means between the base plate and the bearing plate bonding the bearing plate to the base plate, whereby the wear plate adapts to the flatness variances encountered during coupler use.

2. The coupler carrier wear plate of claim 1, wherein the base plate is mild steel.

3. The coupler carrier wear plate of claim 2, wherein the bearing plate is manganese steel.

4. The coupler carrier wear plate of claim 1, wherein the bearing plate is manganese steel.

5. The coupler carrier wear plate of claim 4, wherein the rubber-type resilient means is a urethane bonding material having a Shore 90A durometer hardness.

6. The coupler carrier wear plate of claim 5, wherein the thickness of the rubber-type resilient means is about 0.625 inches.

7. The coupler carrier wear plate of claim 5, wherein at least the central area of the facing surfaces of the base plate and bearing plate are parallel, and the thickness of the rubber-type resilient means between said parallel surfaces is about 0.625 inches.

8. The coupler carrier wear plate of claim 7, wherein the rubber-type resilient means is a urethane bonding material having a Shore 90A durometer hardness.

9. The coupler carrier wear plate of claim 7, wherein the outer ends of the bearing plate are inclined upwardly to cause the coupler shank to center by gravity when the coupler is uncoupled and free to move laterally.

10. The coupler carrier wear plate of claim 1, wherein the rubber-type resilient means is polyurethane.

11. The coupler carrier wear plate of claim 1, wherein the resilient means is a material having a Shore durometer hardness on the A scale.

12. The coupler carrier wear plate of claim 1, wherein the rubber-type resilient means is a urethane bonding material.

13. The coupler carrier wear plate of claim 1, wherein the rubber-type resilient means is a urethane bonding material having a Shore 90A hardness.

14. The coupler carrier wear plate of claim 1, wherein the thickness of the rubber-type resilient means is about 0.625 inches.

* * * * *

UNITED STATES PATENT AND TRADEMARK OFFICE

CERTIFICATE OF CORRECTION

PATENT NO. : 5,598,936

DATED : February 4, 1997

INVENTOR(S) : RICHARD F. MURPHY

It is certified that error appears in the above-indentified patent and that said Letters Patent is hereby corrected as shown below:

Col. 3, line 4, change "car the" to --car. the--

Col. 5, line 12, before "resilient" insert --rubber-type-- and after "Shore" insert --90--.

Signed and Sealed this

Twenty-seventh Day of May, 1997

*Attest:*

Bruce Lehman

BRUCE LEHMAN

*Attesting Officer*

*Commissioner of Patents and Trademarks*